US009546797B2

(12) United States Patent
Kuroiwa

(10) Patent No.: US 9,546,797 B2
(45) Date of Patent: Jan. 17, 2017

(54) AIR CONDITIONER MANAGEMENT DEVICE, AIR CONDITIONER MANAGEMENT SYSTEM, NON-TRANSITORY COMPUTER-READABLE RECORDING MEDIUM AND AIR CONDITIONER MANAGEMENT METHOD

(75) Inventor: Takeru Kuroiwa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 384 days.

(21) Appl. No.: 14/232,704

(22) PCT Filed: Jul. 27, 2011

(86) PCT No.: PCT/JP2011/067152
§ 371 (c)(1),
(2), (4) Date: Jan. 14, 2014

(87) PCT Pub. No.: WO2013/014774
PCT Pub. Date: Jan. 31, 2013

(65) Prior Publication Data

US 2014/0156086 A1 Jun. 5, 2014

(51) Int. Cl.
*G05B 21/00* (2006.01)
*F24F 11/00* (2006.01)

(52) U.S. Cl.
CPC .... *F24F 11/0086* (2013.01); *F24F 2011/0063* (2013.01); *F24F 2011/0091* (2013.01)

(58) Field of Classification Search
CPC ..... F24F 11/0086; F24F 12/12
(Continued)

(56) References Cited

U.S. PATENT DOCUMENTS 4,608,560 A * 8/1986 Allgood ..... H04Q 9/16 340/3.1
5,195,045 A * 3/1993 Keane ..... H01J 37/32082 315/111.51
(Continued)

FOREIGN PATENT DOCUMENTS

JP 2002-312456 A 10/2002
JP 2003-302092 A 10/2003
(Continued)

OTHER PUBLICATIONS

Fan et al, "An Optimization Management Strategy for Energy Efficiency of Air Conditioning Loads in Smart Building", IEEE, pp. 1-5, 2016.*
(Continued)

*Primary Examiner* — Anil Khatri
(74) *Attorney, Agent, or Firm* — Posz Law Group, PLC

(57) ABSTRACT

An air conditioner management device comprises an information inputter entering schedule information presenting a schedule for operating a first air conditioner and a device controller controlling the operation of the first air conditioner based on the entered schedule information. The air conditioner management device further comprises an information communicator receiving information identifying the first air conditioner and operation state information presenting the operation state of the first air conditioner, and information identifying a second air conditioner and operation state information presenting the operation state of the second air conditioner. The air conditioner management device further comprises an information display displaying the operation state information of the first air conditioner and the operation state information of the second air conditioner. Thus, it is possible to display a change in the
(Continued)

operation state of an air conditioner caused by the operation of another air conditioner.

6 Claims, 14 Drawing Sheets

(58) Field of Classification Search
USPC ..... 700/274–278
See application file for complete search history.

(56) References Cited

U.S. PATENT DOCUMENTS

| | | | | |
|---|---|---|---|---|
| 5,706,191 | A * | 1/1998 | Bassett | G01D 4/004 700/274 |
| 6,647,317 | B2 * | 11/2003 | Takai | F24F 11/0086 700/276 |
| 7,302,313 | B2 * | 11/2007 | Sharp | G01N 1/26 700/275 |
| 7,610,116 | B2 * | 10/2009 | Masui | F24F 11/0086 340/12.32 |
| 8,014,902 | B2 * | 9/2011 | Kates | E04H 4/129 4/490 |
| 8,356,697 | B2 * | 1/2013 | Kriss | B66B 5/0031 187/249 |
| 8,600,557 | B2 * | 12/2013 | Masui | F24F 11/0086 700/276 |
| 8,838,416 | B2 * | 9/2014 | Kuroiwa | F25B 49/005 700/276 |
| 8,903,682 | B2 * | 12/2014 | Gyota | F24F 11/0086 62/127 |
| 8,930,146 | B2 * | 1/2015 | Katsukura | G01D 4/002 340/573.1 |
| 2004/0035125 | A1 | 2/2004 | Ishida et al. | |
| 2008/0234869 | A1 | 9/2008 | Yonezawa et al. | |
| 2011/0145395 | A1 | 6/2011 | Kawai | |

FOREIGN PATENT DOCUMENTS

| | | | |
|---|---|---|---|
| JP | 2008-232531 | A | 10/2008 |
| JP | 2009-058187 | A | 3/2009 |
| JP | 2010-038430 | A | 2/2010 |

OTHER PUBLICATIONS

Gubba et al, "Energy Management by Controlling Air Conditioning Systems in Residential Settings", IEEE, pp. 1-5, 2016.*

David et al, "Control Strategy for Power Flow Management in a PV System supplying electrical loads in an Air-Conditioned Bus", IEEE, pp. 1-5, 2014.*

Zhang et al, "Demand-side Management of Air Conditioning Cooling Loads for Intra-hour Load Balancing", IEEE, pp. 1-6, 2013.*

Office Action mailed Aug. 26, 2014 issued in corresponding JP patent application No. 2013-525506 (and English translation).

International Search Report of the International Searching Authority mailed Nov. 15, 2011 for the corresponding international application No. PCT/JP2011/067152 (English translation attached).

* cited by examiner

FIG.6

AIR CONDITIONER DATA

OBJECT ID: A

COOLING SYSTEM ID: C002

CONENCTION INFORMATION

| ADDRESS | 330 |
|---|---|
| CONNECTION DESTINATION ADDRESS | 340 |
| UNIT TYPE | OUTDOOR UNIT |
| ... | ... |

OPERATION STATE INFORMATION

| DATE/TIME | DETECTION ITEM | DETECTED VALUE |
|---|---|---|
| 2010/1/1 10:00 | REFRIGERANT TEMPERATURE1 | 25 |
| 2010/1/1 10:00 | REFRIGERANT TEMPERATURE2 | 50 |
| 2010/1/1 10:01 | REFRIGERANT TEMPERATURE1 | 25 |
| ... | ... | ... |

CONENCTION INFORMATION

| ADDRESS | 340 |
|---|---|
| CONNECTION DESTINATION ADDRESS | 330 |
| UNIT TYPE | INDOOR UNIT |
| ... | ... |

OPERATION STATE INFORMATION

| DATE/TIME | DETECTION ITEM | DETECTED VALUE |
|---|---|---|
| 2010/1/1 10:00 | REFRIGERANT TEMPERATURE1 | 35 |
| 2010/1/1 10:00 | REFRIGERANT TEMPERATURE2 | 20 |
| 2010/1/1 10:01 | REFRIGERANT TEMPERATURE1 | 35 |
| ... | ... | ... |

...

...

FIG.7A

CONNECTION INFORMATION TABLE (BEFORE UPDATE)

| OBJECT ID | COOLING SYSTEM ID | ADDRESS | CONNECTION DESTINATION ADDRESS | UNIT TYPE |
|---|---|---|---|---|
| B | C001 | 310 | 320a, 320b | OUTDOOR UNIT |
| B | C001 | 320a | 310 | INDOOR UNIT |
| B | C001 | 320b | 310 | INDOOR UNIT |
| B | C002 | 330 | 340 | OUTDOOR UNIT |
| B | C002 | 340 | 330 | INDOOR UNIT |
| ... | ... | ... | ... | ... |

FIG.7B

CONNECTION INFORMATION TABLE (AFTER UPDATE)

| OBJECT ID | COOLING SYSTEM ID | ADDRESS | CONNECTION DESTINATION ADDRESS | UNIT TYPE |
|---|---|---|---|---|
| A | C001 | 310 | 320a, 320b | OUTDOOR UNIT |
| A | C001 | 320a | 310 | INDOOR UNIT |
| A | C001 | 320b | 310 | INDOOR UNIT |
| A | C002 | 330 | 340 | OUTDOOR UNIT |
| A | C002 | 340 | 330 | INDOOR UNIT |
| ... | ... | ... | ... | ... |
| B | C001 | 310 | 320a, 320b | OUTDOOR UNIT |
| B | C001 | 320a | 310 | INDOOR UNIT |
| B | C001 | 320b | 310 | INDOOR UNIT |
| B | C002 | 330 | 340 | OUTDOOR UNIT |
| B | C002 | 340 | 330 | INDOOR UNIT |
| ... | ... | ... | ... | ... |

FIG.9

SCHEDULE INFORMATION TABLE

| TEST-RUN SCHEDULE ID | SCHEDULED START DATE/TIME | SCHEDULED END DATE/TIME | TEST-RUN MODE | TEST-RUN UNIT ADDRESS |
|---|---|---|---|---|
| A-1 | 2010/01/01 10:05 | 2010/01/01 10:15 | COOLING | 310 |
| A-2 | 2010/01/01 10:15 | 2010/01/01 10:30 | HEATING | 320a |
| ... | ... | ... | ... | ... |

FIG.11

OPERATION STATE INFORMATION TABLE

| OBJECT ID | COOLING SYSTEM ID | ADDRESS | DETECTION DATE/TIME | DETECTION ITEM | DETECTED VALUE |
|---|---|---|---|---|---|
| A | C001 | 310 | 2010/1/1 10:00 | REFRIGERANT TEMPERATURE1 | 25 |
| A | C001 | 310 | 2010/1/1 10:00 | REFRIGERANT TEMPERATURE2 | 50 |
| A | C001 | 310 | 2010/1/1 10:01 | REFRIGERANT TEMPERATURE1 | 25 |
| A | C001 | 310 | 2010/1/1 10:01 | REFRIGERANT TEMPERATURE2 | 50 |
| ... | ... | ... | ... | ... | ... |
| A | C001 | 320a | 2010/1/1 10:00 | REFRIGERANT TEMPERATURE1 | 35 |
| A | C001 | 320a | 2010/1/1 10:00 | REFRIGERANT TEMPERATURE2 | 20 |
| ... | ... | ... | ... | ... | ... |
| A | C001 | 320b | 2010/1/1 10:00 | REFRIGERANT TEMPERATURE1 | 30 |
| A | C001 | 320b | 2010/1/1 10:00 | REFRIGERANT TEMPERATURE2 | 30 |
| ... | ... | ... | ... | ... | ... |

FIG.12

DETECTION ITEM INFORMATION TABLE

| SENSOR ID | DETECTION ITEM |
|---|---|
| 311a | REFRIGERANT TEMPERATURE 1 |
| 311b | REFRIGERANT TEMPERATURE 2 |
| 321a | REFRIGERANT TEMPERATURE 1 |
| 322a | REFRIGERANT TEMPERATURE 1 |
| 321b | REFRIGERANT TEMPERATURE 2 |
| 322b | REFRIGERANT TEMPERATURE 1 |
| 331 | REFRIGERANT TEMPERATURE 1 |
| 341 | REFRIGERANT TEMPERATURE 1 |
| 342 | REFRIGERANT TEMPERATURE 2 |
| ... | ... |

AIR CONDITIONER MANAGEMENT DEVICE, AIR CONDITIONER MANAGEMENT SYSTEM, NON-TRANSITORY COMPUTER-READABLE RECORDING MEDIUM AND AIR CONDITIONER MANAGEMENT METHOD

CROSS REFERENCE TO RELATED APPLICATION

This application is a U.S. national stage application of PCT/JP2011/067152 filed on Jul. 27, 2011, the contents of which are incorporated herein by reference.

TECHNICAL FIELD

The present invention relates to an air conditioner management device, an air conditioner management system, a non-transitory computer-readable recording medium, and an air conditioner management method.

BACKGROUND

Systems comprising multiple local management devices collecting data for use in managing air-conditioning devices (air conditioners, hereafter) installed in multiple buildings and a central management device receiving the data for use in the management from the multiple local management devices are known (for example, see Patent Literature 1).

When a new air conditioner is connected, the multiple local management devices each send data for use in managing the connected air conditioner to the central management device. The central management device starts managing the newly connected air conditioner using the received data.

PATENT LITERATURE

Patent Literature 1: Unexamined Japanese Patent Application Kokai Publication No. 2010-038430.

For example, for managing the operation states of multiple air conditioners, the technique disclosed in the Patent Literature 1 displays a list of operation states presented by the data collected from the air conditioners installed in multiple buildings. Then, a problem is that a change in the operation state of an air conditioner caused by the operation of another air conditioner is not displayed.

SUMMARY

The present invention is invented under the above circumstances and an exemplary objective of the present invention is to provide an air conditioner management device, air conditioner management program, and air conditioner management method capable of displaying a change in the operation state of an air conditioner caused by the operation of another air conditioner.

In order to achieve the above objective, the air conditioner management device of the present invention comprises:

an information storage associating and storing information identifying a first air conditioner and information identifying a second air conditioner connected to the first air conditioner via a pipe;

an information inputter entering schedule information presenting a schedule for operating the first air conditioner;

a device controller controlling the operation of the first air conditioner based on the entered schedule information;

an information communicator receiving the information identifying the first air conditioner and operation state information presenting the operation state of the first air conditioner, and the information identifying the second air conditioner and operation state information presenting the operation state of the second air conditioner; and an information display displaying the operation state information of the first air conditioner and the operation state information of the second air conditioner identified by the information stored in the information storage in association with the information identifying the first air conditioner.

The air conditioner management device, the air conditioner management system, the non-transitory computer-readable recording medium, and the air conditioner management method according to the present invention can display a change in the operation state of an air conditioner caused by the operation of another air conditioner.

BRIEF DESCRIPTION OF DRAWINGS

FIG. 6 is an illustration presenting an example of air conditioner data stored by the air conditioner management device;

FIG. 7A is an illustration presenting an example of the connection information table stored by the air conditioner management device before update;

FIG. 7B is an illustration presenting an example of the connection information table stored by the air conditioner management device after update;

FIG. 9 is an illustration presenting an example of the schedule information table stored by the air conditioner management device;

FIG. 11 is an illustration presenting an example of the operation state information table stored by the air conditioner management device;

FIG. 12 is an illustration presenting an example of the detection item information table stored by the air conditioner management device.

DETAILED DESCRIPTION

An air-conditioning management system 1 comprising an air-conditioner management device 200 according to an embodiment of the present invention will be described hereafter with reference to the attached drawings.

Figure 1:
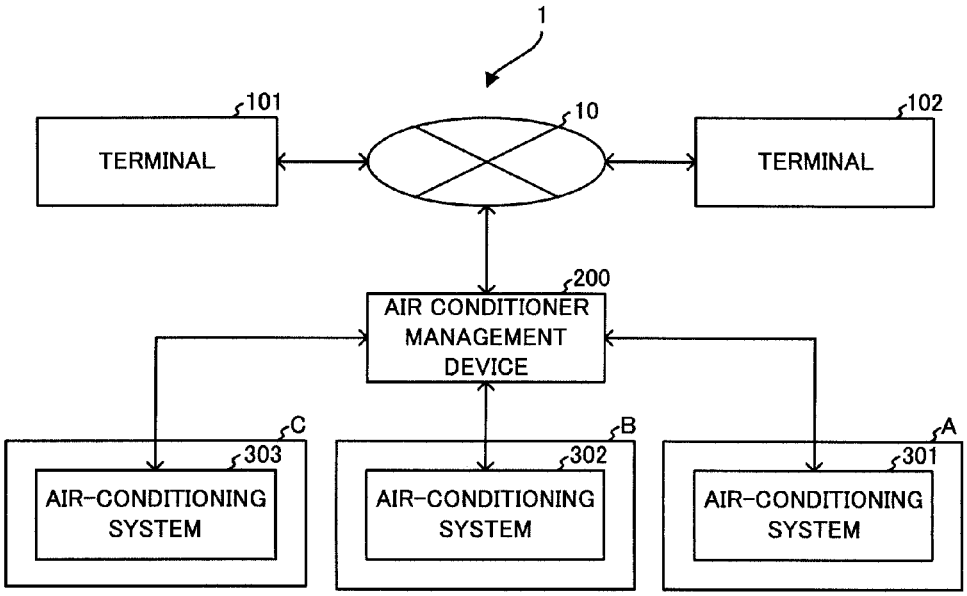
FIG. 1 is a configuration diagram presenting an exemplary air-conditioning management system comprising the air conditioner management device according to an embodiment of the present invention.

The air conditioner management device 200 according to an embodiment of the present invention is installed in the air-conditioning management system 1 as shown in FIG. 1. The air-conditioning management system 1 comprises, in addition to the air conditioner management device 200, a computer communication network 10 (simply the communication network 10, hereafter), terminals 101 and 102, an air-conditioning system 301 installed in a building A, an air-conditioning system 302 installed in a building B, and an air-conditioning system 303 installed in a building C.

Here, the air-conditioning system 301 installed in a building A, air-conditioning system 302 installed in a building B, and air-conditioning system 303 installed in a building C have the same configuration. Therefore, the air-conditioning system 301 installed in a building A will be described and the explanation of the air-conditioning system 302 installed in a building B and air-conditioning system 303 installed in a building C is omitted. Furthermore, the terminals 101 and 102 have the same configuration. Therefore, the terminal 101 will mainly be described hereafter and the explanation of the terminal 102 is omitted.

The communication network 10 is configured, for example, by the Internet. The communication network 10 can be a LAN (local area network) or public line network.

The terminal 101 is configured, for example, by a personal computer comprising a display such as a LCD (liquid crystal display) and an inputter such as a keyboard and a mouse. As the user operates the inputter, the terminal 101 enters various kinds of information and sends the entered information to the air conditioner management device 200. Furthermore, the terminal 101 receives various kinds of information from the air conditioner management device 200 and displays the received information on the display.

The air conditioner management device 200 conducts test-run of the air-conditioning systems 301 to 303, collects information presenting the operation states of the air-conditioning systems 301 to 303 (the operation state information, hereafter), and displays the collected operation state information.

Figure 2:
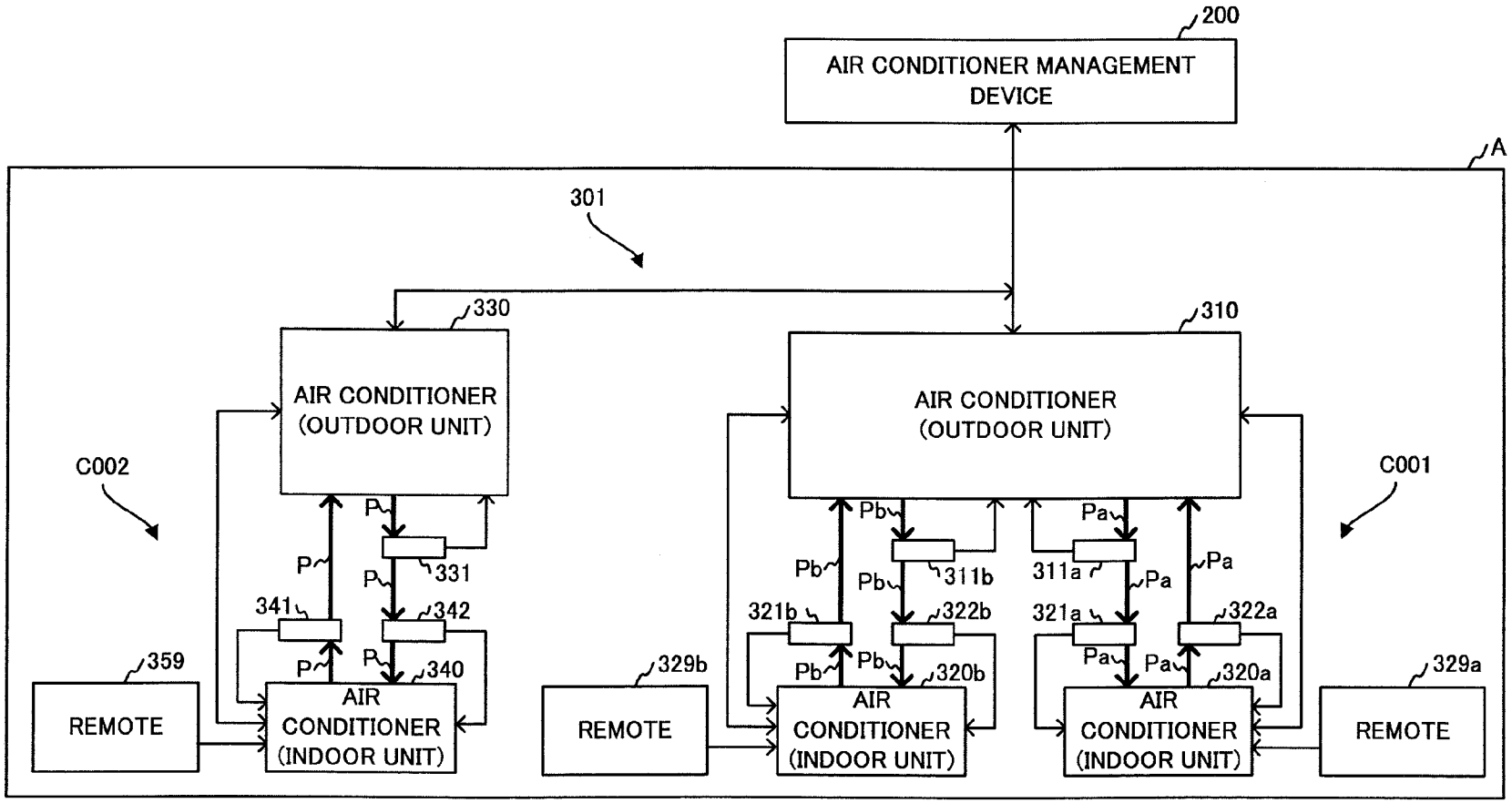
FIG. 2 is a configuration diagram presenting an exemplary air-conditioning system.

The air-conditioning system 301 installed in a building A comprises, as shown in FIG. 2, air-conditioning devices (the air conditioners, hereafter) 310, 320*a*, 320*b*, 330, and 340, and remote controllers (the remotes, hereafter) 329*a*, 329*b*, and 359.

The air conditioners 310 and 330 are outdoor units. The air conditioners 310 and 330 each comprise a compressor compressing a refrigerant to raise the temperature and pressure of the refrigerant, an expander expanding the refrigerant to lower the temperature and pressure of the refrigerant, and a circulation pump circulating the refrigerant.

The air conditioner 310 is connected to the air conditioner 320*a* and air conditioner 320*b*, which are indoor units, via separate, dedicated lines. The air conditioner 310 is connected to the air conditioners 320*a* and 320*b* via refrigerant pipes Pa and Pb, respectively, through which the refrigerant runs. The air conditioner 310 supplies the refrigerant to the air conditioners 320*a* and 320*b* according to control signals output from the air conditioner 320*a* via a dedicated line, and receives the refrigerant, which is cooler or warmer than when it was supplied, from the air conditioners 320*a* and 320*b*.

A sensor 311*a* detecting the temperature of the refrigerant miming through the refrigerant pipe Pa is provided on the refrigerant pipe Pa closer to the air conditioner 310. A sensor 311*b* detecting the temperature of the refrigerant running through the refrigerant pipe Pb is provided on the refrigerant pipe Pb closer to the air conditioner 310. The sensors 311*a* and 311*b* each send detected value information presenting the detected temperature to the air conditioner 310.

Furthermore, sensors 321*a* and 322*a* are provided on the refrigerant pipe Pa closer to the air conditioner 320*a*. The sensors 321*a* and 322*a* each send detected value information presenting the detected value of the temperature of the refrigerant running through the refrigerant pipe Pa to the air conditioner 320*a*. Similarly, sensors 321*b* and 322*b* are provided on the refrigerant pipe Pb closer to the air conditioner 320*b*. The sensors 321*b* and 322*b* each send detected value information presenting the detected value of the temperature of the refrigerant running through the refrigerant pipe Pb to the air conditioner 320*b*.

The air conditioner 320*a* is connected to the remote 329*a* that is an operation terminal. The air conditioner 320*a* sends the air cooled, heated, or dehumidified with the refrigerant supplied from the air conditioner 310 in accordance with an operation mode change command, operation command, stop command, fan command, or set temperature change command output from the remote 329*a* operated by the user. Similarly, the air conditioner 320*b* is connected to the remote 329*b* and operates in accordance with various commands output from the remote 329*b*.

Here, the operation mode change command is the command to change the operation mode of the air conditioner to one of the heating, cooling, and dehumidification modes. The operation command is the command to start the operation. The stop command is the command to stop the operation. The fan command is the command to operate the fan. Furthermore, the set temperature change command is the command to change the temperature set at the air conditioner 320*a*.

A circulation system C001 comprising the air conditioner 310 circulating the heated or cooled refrigerant, air conditioners 320*a* and 320*b* operating with the heated or cooled refrigerant, and refrigerant pipes Pa and Pb through which the refrigerant runs to circulate between the air conditioner 310 and the air conditioners 320*a* and 320*b* as described above is referred to as a cooling system C001. Similarly, a circulation system C002 comprising the air conditioner 330 circulating the heated or cooled refrigerant, air conditioner 340 operating with the heated or cooled refrigerant, and a refrigerant pipe P through which the refrigerant runs to circulate between the air conditioner 330 and air conditioner 340 is referred to as a cooling system C002.

Here, sensors 331, 341, and 342 have the same configuration as the sensors 311*a*, 321*a*, and 322*a* and their explanation is omitted. Furthermore, a remote 359 has the same configuration as the remote 329*a* and its explanation is omitted.

Figure 3:
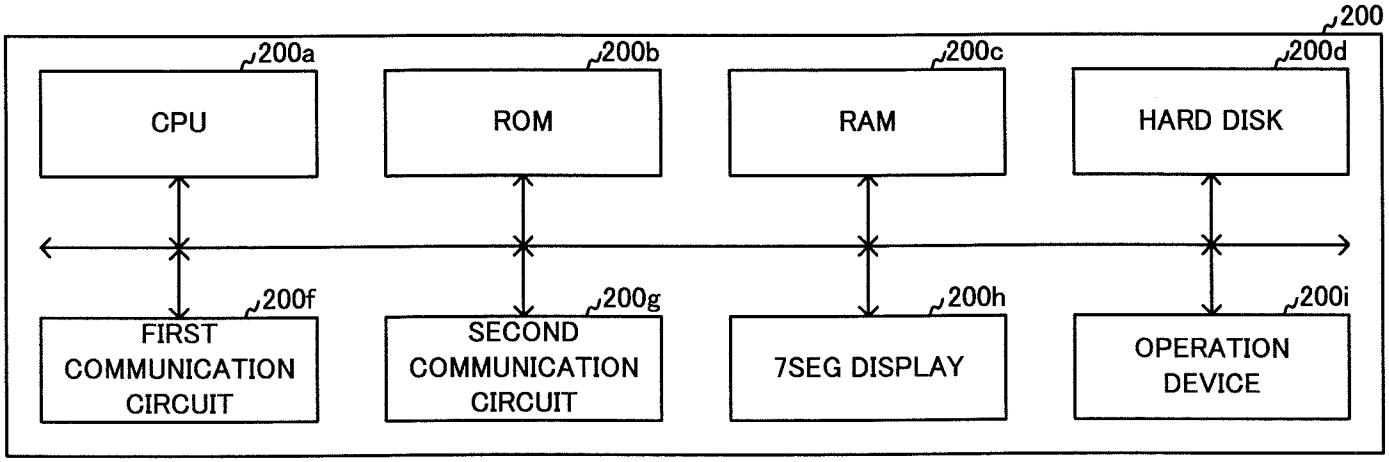
FIG. 3 is a hardware configuration diagram presenting an exemplary configuration of the air conditioner management device.

The air conditioner management device 200 is mounted on a wall of a building or the like and comprises, as shown in FIG. 3, a CPU (central processing unit) 200*a*, a ROM (read only memory) 200*b*, a RAM (random access memory) 200*c*, a hard disk 200*d*, a first communication circuit 200*f*, a second communication circuit 200*g*, a 7SEG (segment) display 200*h*, and an operation device 200*i*. Incidentally, the air conditioner management device 200 can be configured by a personal computer.

The CPU 200*a* executes programs stored in the ROM 200*b* or hard disk 200*d* to control the entire air conditioner management device 200. The RAM 200*c* temporarily stores data to be processed while the CPU 200*a* executes the programs.

The hard disk 200*d* stores tables retaining various kinds of data. Incidentally, the air conditioner management device 200 can comprise a flash memory in place of the hard disk 200*d*.

The first communication circuit 200*f* serves for information communication with the terminal 101 connected via the communication network 10. The second communication circuit 200*g* serves for various kinds of information communication with the air conditioner 310 connected via a dedicated line and with the air conditioners 320*a* and 320*b* connected via the air conditioner 310. Similarly, the second communication circuit 200*g* serves for various kinds of information communication with the air conditioner 330 connected via a dedicated line and with the air conditioner 340 connected via the air conditioner 330.

Incidentally, the first and second communication circuits 200*f* and 200*g* can be serial communication circuits such as USB (universal serial bus) communication circuits, or parallel communication circuits. Furthermore, the first and second communication circuits 200*f* and 200*g* can be wired communication circuits or wireless communication circuits. Furthermore, the communication protocol used by the first and second communication circuits 200*f* and 200*g* can be a protocol intrinsic to the air-conditioning management system 1.

The 7SEG display 200*h* displays various kinds of information according to signals output from the CPU 200*a*. The operation device 200*i* comprises operation buttons operated by the user and an electronic circuit entering signals corresponding to the operation on the operation buttons by the user. Incidentally, the operation device 200*i* can be configured by a touch panel or a keyboard.

Figure 4:
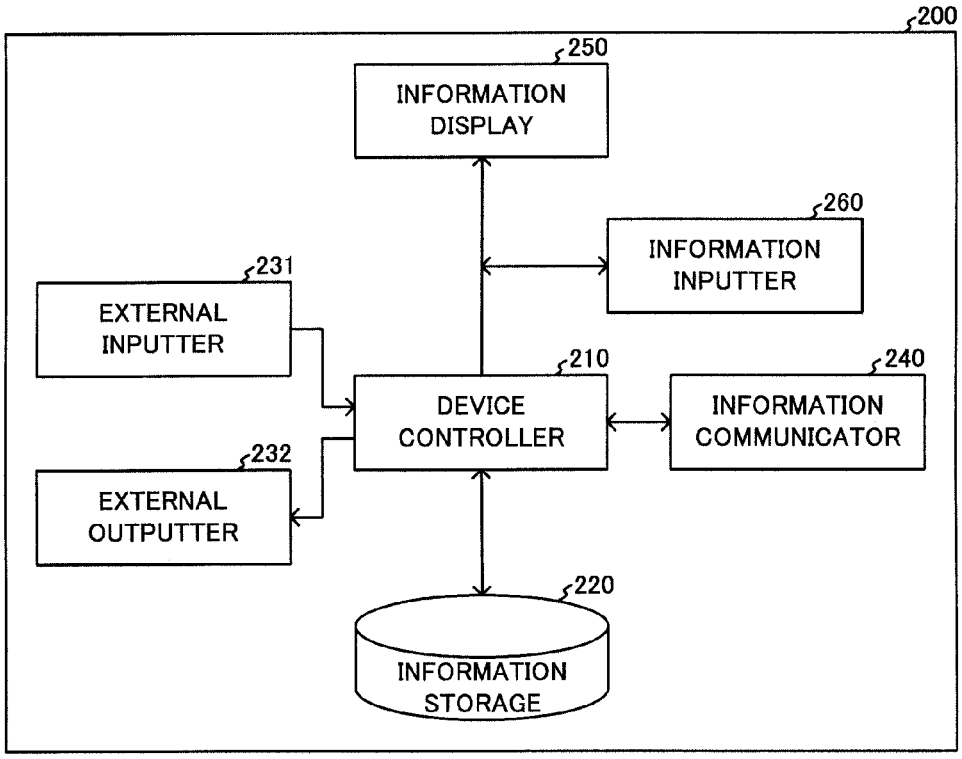
FIG. 4 is a functional block diagram presenting exemplary functions of the air conditioner management device.

Executing the programs stored in the ROM 200*b* or hard disk 200*d*, the CPU 200*a* functions as a device controller 210 controlling the operation of the air conditioner 310 and the like as shown in FIG. 4. Furthermore, the CPU 200*a* cooperates with the hard disk 200*d* to function as an information storage 220 storing information used in executing the programs. Furthermore, the CPU 200*a* cooperates with the first communication circuit 200*f* to function as an external inputter 231 entering information sent from the terminal 101 into the device controller 210 and as an external outputter 232 outputting information output from the device controller 210 to the terminal 101. Furthermore, the CPU 200*a* cooperates with the second communication circuit 200*g* to function as an information communicator 240 relaying information upon communication between the device controller 210 and the air conditioner 310 and the like. Furthermore, the CPU 200*a* cooperates with the 7SEG display 200*h* to function as an information display 250 displaying information output from the device controller 210. Furthermore, the CPU 200*a* cooperates with the operation device 200*i* to function as an information inputter 260 operated by the user and entering information corresponding to the operation into the device controller 210.

The user of the air-conditioning management system 1 conducts an operation on the operation device 200*i* to start a connection identification procedure to identify the connection arrangement of an air conditioner in order to start managing operation state information presenting the operation state of an air conditioner installed in a building different from the building in which the air conditioners of which the operation state information is managed by the air-conditioning management system 1 are installed (for adding a new building to the air-conditioning management system 1, hereafter) or when there is a change in the connection arrangement of an air conditioner of which the operation state information is already managed by the air-conditioning management system 1.

Figure 5:
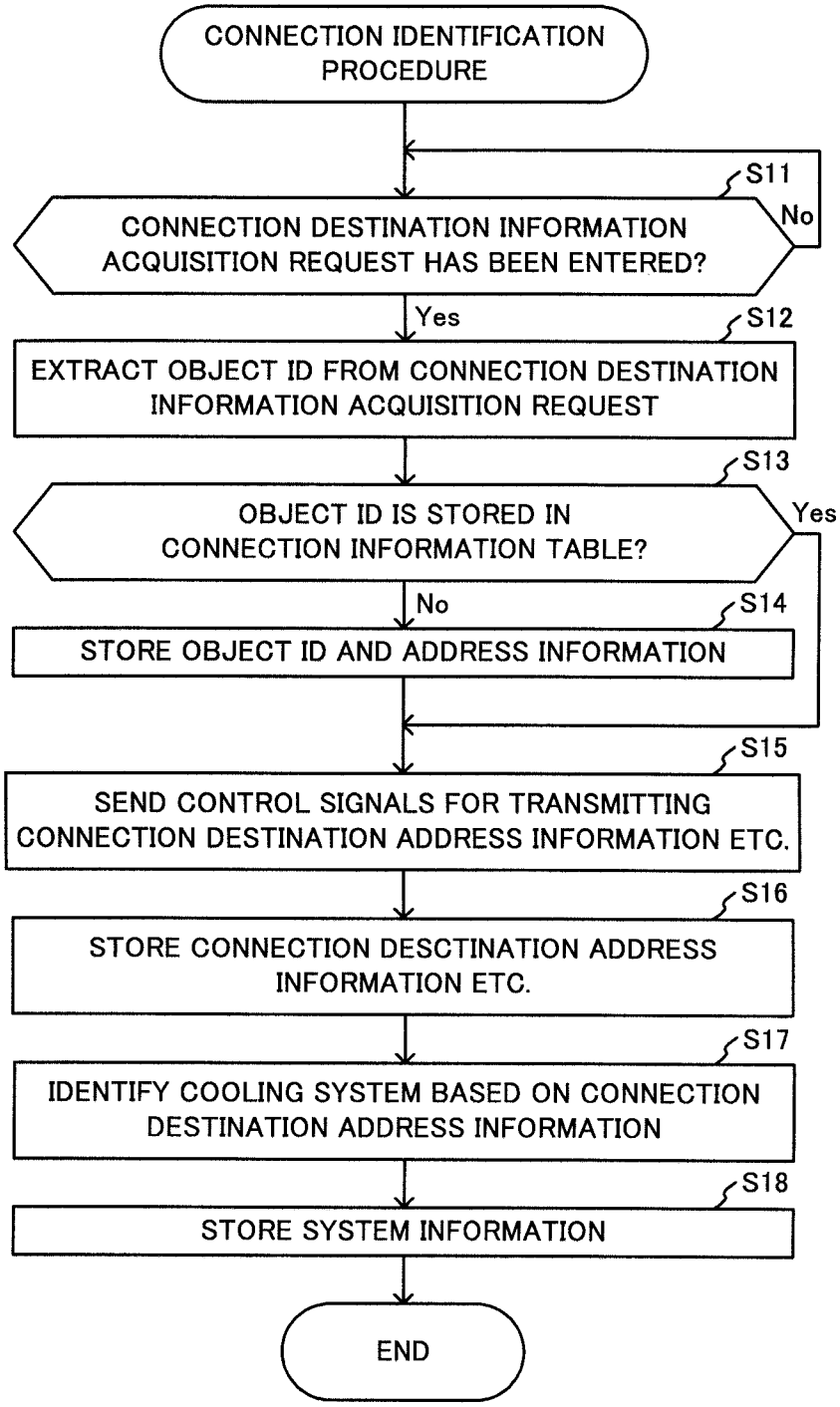
FIG. 5 is a flowchart presenting an example of the connection identification procedure executed by the air conditioner management device.

As the operation is conducted, the operation device 200*i* enters a predetermined signal corresponding to the operation into the CPU 200*a*. With the predetermined signal being entered, the CPU 200*a* executes the connection identification procedure as shown in FIG. 5.

Prior to description of the connection identification procedure, data used in the connection identification procedure will be described hereafter.

The information storage 220 shown in FIG. 4 stores air conditioner data as shown in FIG. 6. The air conditioner data comprises connection information presenting the relationship between connected air conditioners and operation state information presenting the operation states of the air conditioners. The connection information and operation state information are classified (namely grouped) on the basis of cooling systems comprising multiple air conditioners and buildings in which the multiple air conditioners are installed.

The connection information contained in the air conditioner data of FIG. 6 is stored in a connection information table as shown in FIG. 7A. The connection information presenting the connection arrangement of the air conditioners installed in a building that is added to the air-conditioning management system 1 or the connection information presenting the connection arrangement after any change is made is stored in the connection information table as the connection identification procedure is executed.

The connection information is information associating information identifying a building in which an air conditioner is installed (the object ID, hereafter), information identifying the cooling system comprising air conditioners installed in the building (the cooling system ID, hereafter), information presenting the address used for distinguishing the air conditioner from the other air conditioners in communication via a dedicated line (namely, information identifying the air conditioner), information presenting the address identifying the connection destination to which the air conditioner is connected via a refrigerant pipe (the connection destination address information, hereafter), and information presenting that the air conditioner is an outdoor unit or an indoor unit.

The connection identification procedure executed using the above data will be described hereafter.

As the CPU 200*a* shown in FIG. 3 starts executing the connection identification procedure shown in FIG. 5, the information display 250 shown in FIG. 4 display a massage urging entry of the object ID identifying the building that is added to the air-conditioning management system 1 or the building in which the connection arrangement of an installed air conditioner is changed.

Then, as the user who has viewed the message operates the operation device 200*i*, the information inputter 260 realized by the operation device 200*i* enters a request containing an object ID "A" corresponding to the operation of the user and calling for acquisition of the connection destination address information of the air conditioner 310 and the like from the air conditioner 310 and the like installed in the building A identified by the object ID "A" (the connection destination information acquisition request, hereafter) into the device controller 210.

Then, the device controller 210 determines whether a connection destination information acquisition request has been entered (Step S11). At this point, the device controller 210 determines that a connection destination information acquisition request containing the object ID "A" is entered from the information inputter 260 (Step S11; Yes), and extracts the object ID "A" from the connection destination information acquisition request (Step S12). Here, if it is determined that no connection destination information acquisition request has been entered in the Step S11 (Step S11; No), the device controller 210 repeats the above processing of the Step S11 after a predetermined time has elapsed.

Then, the device controller 210 determines whether the extracted object ID "A" is already stored in the connection information table shown in FIG. 7A in order to determine whether a new building is added to the air-conditioning management system 1 (Step S13). More specifically, since the extracted object ID "A" is not stored in the connection information table, the device controller 210 determines that a new building A is added to the air-conditioning management system 1. Here, the device controller 210 determines that it is not the case of addition of the building A to the air-conditioning management system 1 when the extracted object ID "A" is stored in the connection information table.

If the device controller 210 determines that the extracted object ID "A" is not stored in the Step S13 (Step S13; No), the information display 250 displays a message urging entry of the address information of air conditioners installed in the building A identified by the entered object ID "A." Then, the information inputter 260 realized by the operation device 200*i* operated by the user who has viewed the message enters the address information of the air conditioners 310, 320*a*, 320*b*, 330, and 340 installed in the building A. Subsequently, the device controller 210 associates and stores the entered address information and the object ID extracted in the Step S12 in the connection information table of FIG. 7A so as to update the connection information table as shown in FIG. 7B (Step S14).

After the Step S14, the device controller 210 searches the connection information table of FIG. 7B for the address information associated with the object ID "A." This is for searching for the address information of the air conditioners installed in the building A identified by the object ID "A." Then, the information communicator 240 of FIG. 5 sends control signals to the air conditioners 310, 320*a*, 320*b*, 330, and 340 using the addresses presented by multiple pieces of address information found for urging the air conditioners 310, 320*a*, 320*b*, 330, and 340 to send the connection destination address information (Step S15). Here, even if it is determined that the extracted object ID is already stored in the Step S13 (Step S13; Yes), the processing of the Step S15 is executed as well.

Then, the information communicator 240 receives the address information identifying the air conditioner 310 and the like, address information identifying the other air conditioners that are connected to the air conditioner 310 and the like (namely, the connection destination address information), and unit type information presenting the unit types of the air conditioner 310 and the like from the air conditioner 310 and the like that have received the control signals.

Then, the device controller 210 determines that neither connection destination address information nor unit type information associated with the object ID extracted in the Step S12 and address information received in the Step S15 is stored in the connection information table of FIG. 7B. Then, the device controller 210 stores the connection destination address information and unit type information received in the Step S15 in association with the extracted object ID "A" and found address information (Step S16).

Here, if it is determined that any connection destination address information and unit type information associated with the extracted object ID and found address information are stored in the connection information table of FIG. 7B, the device controller 210 updates the connection destination address information and unit type information with the connection destination address information and unit type information received in the Step S15.

After the Step S16, the device controller 210 identifies the cooling system of the air conditioner 310 and the like installed in the building A identified by the object ID "A" extracted in the Step S12 based on the connection destination information stored in the connection information table shown in FIG. 7A (Step S17).

More specifically, the device controller 210 identifies the air conditioners 310, 320*a*, and 320*b* as belonging to the same cooling system because the air conditioner 310 identified by the address information stored in a record of the connection information table shown in FIG. 7B is connected to the air conditioners 320*a* and 320*b* identified by the connection destination address information stored in the record. Similarly, the device controller 210 identifies the air conditioners 330 and 340 as belonging to the same cooling system. Then, the device controller 210 creates a cooling system ID "C001" for the cooling system comprising the air conditioners 310, 320*a*, and 320*b* and creates a cooling system ID "C002" for the cooling system comprising the air conditioners 330 and 340.

Then, the device controller 210 determines that no cooling system ID associated with the object ID "A" of the building and the address information "310" of the air conditioner 310 installed in the building A is stored in the connection information table shown in FIG. 7B. Then, the device controller 210 stores the cooling system ID "C001" in association with the object ID "A" and address information "310" (Step S18). Here, if it is determined that any cooling system ID associated with the object ID "A" and address information "310" is already stored, the device controller 210 updates the cooling system ID associated with the object ID "A" and address information "310" to the cooling system ID "C001."

Similarly, the device controller 210 stores in the connection information table the cooling system ID "C001" in association with the object ID "A" and address information "320*a*" and the cooling system ID "C001" in association with the object ID "A" and address information "320*b*." Furthermore, the device controller 210 stores in the connection information table the cooling system ID "C002" in association with the object ID "A" and address information "330" and the cooling system ID "C002" in association with the object ID "A" and address information "340." Subsequently, the device controller 210 ends the execution of the connection identification procedure.

Figure 8:
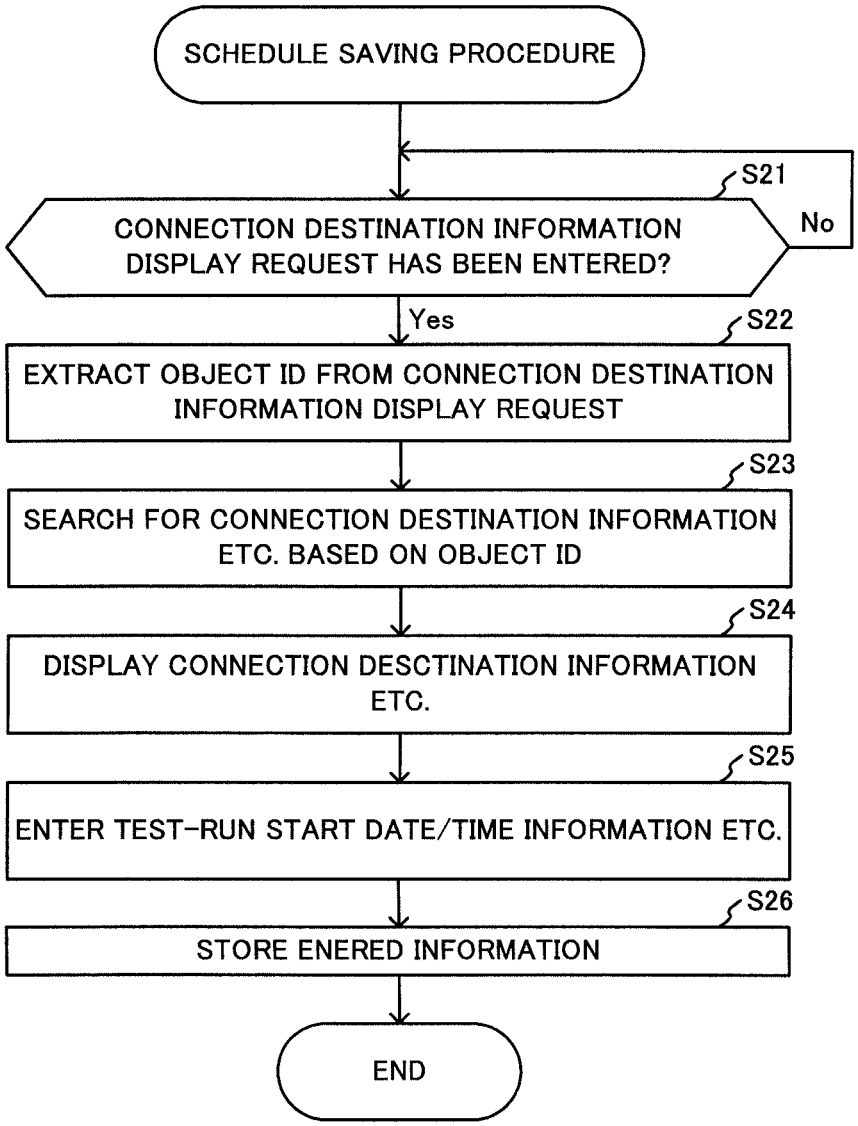
FIG. 8 is a flowchart presenting an example of the schedule saving procedure executed by the air conditioner management device.

Then, for example, in order to check whether the air conditioners in the building added to the air-conditioning management system 1 operate normally, to check whether the air conditioners of which the connection arrangement is changed operate normally, or to check the operation of the air conditioners routinely, the user of the air-conditioning management system 1 creates a schedule for test-run of the air conditioners. Then, in order to save information presenting the created schedule into the Air conditioner management device 200, the user conducts an operation on the operation device 200*i* to give an order to execute a schedule saving procedure to save schedule information presenting the schedule. Subsequently, the information inputter 260 realized by the operation device 200*i* enters a signal corresponding to the operation into the CPU 200*a*. With the signal corresponding to the operation being entered, the CPU 200*a* executes the schedule saving procedure as shown in FIG. 8.

Prior to description of the schedule saving procedure, data used in the schedule saving procedure will be described hereafter.

The information storage 220 shown in FIG. 4 stores a schedule information table in which the schedule information is saved as shown in FIG. 9. The schedule information saved in the schedule information table is information associating a test-run schedule ID identifying a test-run schedule, a scheduled start date/time information presenting the date/time when the scheduled test-run starts (the scheduled start date/time, hereafter), a scheduled end date/time information presenting the date/time when the test-run ends (the scheduled end date/time, hereafter), information presenting the mode specified by the user as the operation mode at the test-run (the test-run mode information, hereafter), and address information identifying the air conditioner specified for the test-run (the test-run unit address information, hereafter).

Here, the test-run schedule ID contains the object ID of the building in which the scheduled test-run air conditioner is installed. Furthermore, the dates/times presented by the scheduled start date/time and scheduled end date/time can be relative dates/times from a specific date/time or absolute dates/times.

The schedule saving procedure executed using the above data will be described hereafter.

As the CPU 200*a* shown in FIG. 3 starts executing the schedule saving procedure shown in FIG. 8, the information display 250 shown in FIG. 4 displays a message urging entry of the object ID identifying the building in which the test-run air conditioner is installed.

Then, as the user who has viewed the message operates the operation device 200*i*, the information inputter 260 realized by the operation device 200*i* enters a request containing the object ID corresponding to the operation of the user and calling for display of the connection destination information presenting the connection destinations of the air conditioner installed in the building identified by the object ID (the connection destination information display request, hereafter) into the device controller 210.

Then, the device controller 210 determines whether a connection destination information display request has been entered from the information inputter 260 (Step S21). At this point, if it is determined that no connection destination information display request has been entered (Step S21; No), the device controller 210 repeats the above processing from the Step S21 after a predetermined time has elapsed.

On the other hand, if it is determined that a connection destination information display request has been entered (Step S21; Yes), the device controller 210 extracts the object ID from the entered connection destination information display request (Step S22). Then, the device controller 210 searches the connection information table of FIG. 7B for the cooling system ID, address information, connection destination address information, and unit type information associated with the extracted object ID (Step S23). Then, the information display 250 of FIG. 4 displays the object ID extracted in the Step S22 and the cooling system ID, address information, connection destination address information, and unit type information found in the Step S23 (Step S24).

A specific case in which the extracted object ID is "A" will be described hereafter. In this case, it is displayed in the Step S24 that the cooling system identified by the cooling system ID "C001" comprises the air conditioners 310, 320*a*, and 320*b* in the building A identified by the object ID "A." Therefore, the user who has viewed the information displayed by the information display 250 acknowledges, for example, that a test-run of the air conditioner 320*a* makes it possible to check influence on the operation of the air conditioners 310 and 320*b* constituting the same cooling system. Then, the user conducts an operation on the operation device 200*i* to enter schedule information presenting a test-run schedule of the air conditioner 320*a*. The information inputter 260 realized by the operation device 200*i* enters scheduled start date/time information presenting the date/time when the test-run of the air conditioner 320*a* starts, scheduled end date/time information presenting the date/time when the test-run of the air conditioner 320*a* ends, test-run mode information presenting the operation mode at the test-run, and test-run unit address information presenting the address identifying the air conditioner 320*a* according to the operation (Step S25).

Subsequently, the device controller 210 creates a test-run schedule ID identifying the test-run schedule presented by the entered information. Then, the device controller 210 associates and stores the created test-run schedule ID and the entered scheduled start date/time information, scheduled end date/time information, test-run mode information, and test-run unit address information in the schedule information table shown in FIG. 9 (Step S26), and ends the schedule saving procedure.

Figure 10:
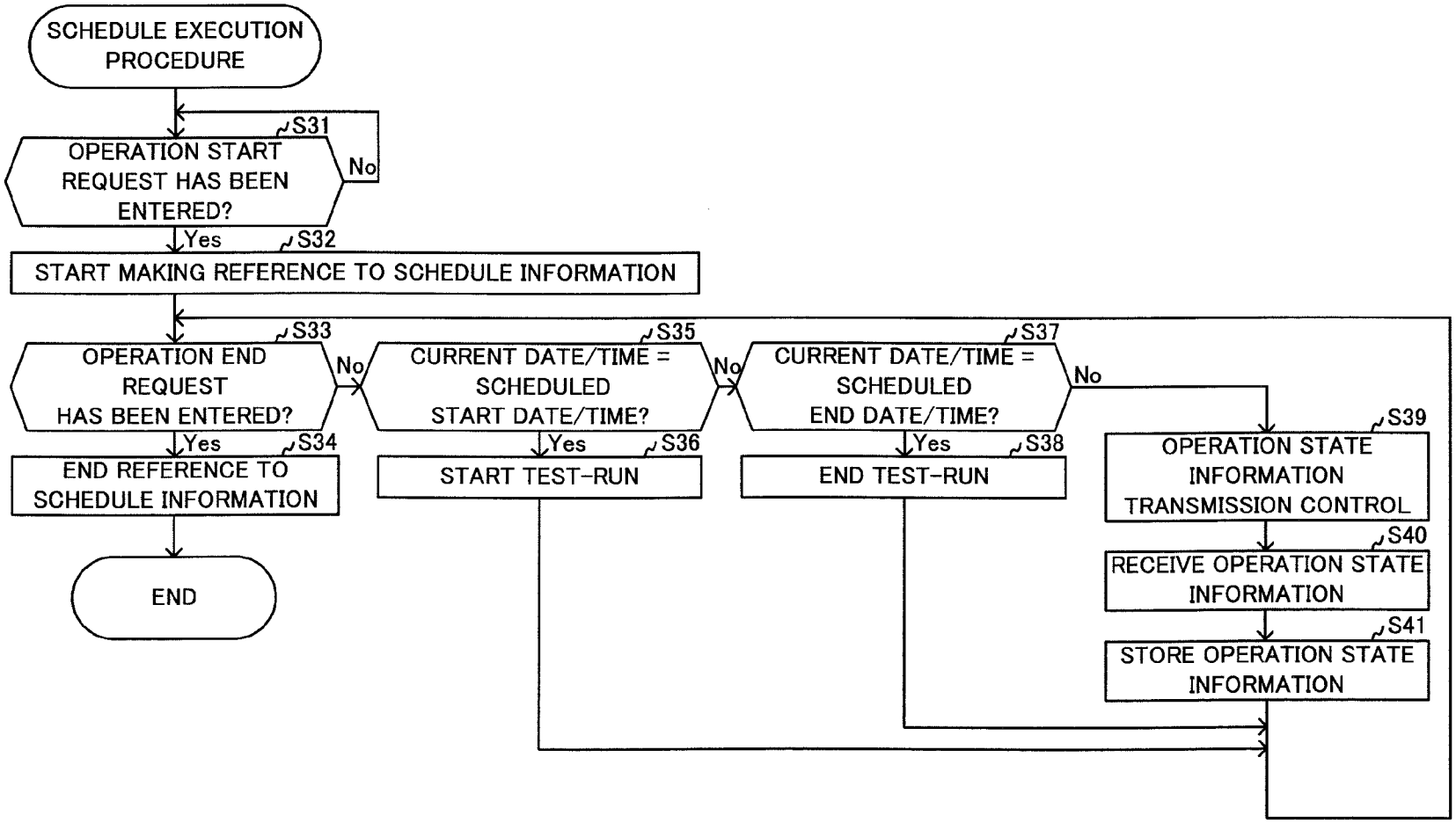
FIG. 10 is a flowchart presenting an example of the schedule execution procedure executed by the air conditioner management device.

Here, upon power-on, the CPU 200*a* of FIG. 3 starts a schedule execution procedure to start the scheduled test-run as shown in FIG. 10.

Prior to description of the schedule execution procedure, data used in the schedule execution procedure will be described hereafter.

The information storage 220 shown in FIG. 4 stores an operation state information table as shown FIG. 11 storing operation state information presenting the operation states of air conditioners having undergone test-run through execution of the schedule execution procedure. The operation state information is information associating the object ID of the building in which the air conditioner is installed, the cooling system ID of the cooling system comprising the air conditioner, address information of the air conditioner, information presenting the date/time when the sensor connected to the air conditioner detected the temperature of the refrigerant (the detection date/time information, hereafter), information presenting the item detected by the sensor (the detection item information, hereafter), and information presenting the detected value of the sensor (the detected value information, hereafter).

Furthermore, the information storage 220 of FIG. 4 stores a detection item information table as shown in FIG. 12. The detection item information table stores information associating information identifying the sensors constituting the air-conditioning management system 1 (the sensor ID, hereafter) and information presenting the detection items to be detected by the sensors.

The schedule execution procedure executed using the above data will be described hereafter.

As the CPU 200*a* shown in FIG. 3 starts executing the schedule execution procedure shown in FIG. 10, the information display 250 shown in FIG. 4 displays a message urging execution of a predetermined start operation to start executing the schedule after the preparation for air conditioner test-run is completed.

Then, the user who has viewed the message conducts the start operation on the operation device 200*i* after confirming that the preparation for air conditioner test-run is completed. Subsequently, the information inputter 260 realized by the operation device 200*i* enters a request for starting the scheduled operation (the operation start request, hereafter) into the device controller 210.

The device controller 210 determines whether an operation start request has been entered from the information inputter 260 (Step S31). At this point, if it is determined that no operation start request has been entered (Step S31; No), the device controller 210 repeats the processing of the Step S31 after a predetermined time has elapsed. On the other hand, if it is determined that an operation start request has been entered (Step S31; Yes), the device controller 210 starts making reference to the schedule information stored in the schedule information table as shown in FIG. 9 (Step S32).

Then, the information display 250 displays a message urging execution of a predetermined call-off operation for calling off the air conditioner test-run. If the user conducts the call-off operation on the operation device 200*i*, the information inputter 260 realized by the operation device 200*i* enters a request for ending the operation of the air conditioner (the operation end request, hereafter) into the device controller 210.

Subsequently, the device controller 210 determines whether an operation end request has been entered from the information inputter 260 (Step S33). At this point, if it is determined that no operation end request has been entered (Step S33; No), the device controller 210 acquires, for example, the system date/time managed by the OS (operation system) (namely the current date/time) and determines whether the acquired current date/time matches any of the scheduled start dates/times presented by the information stored in the schedule information table of FIG. 9 (Step S35).

At this point, if it is determined that the acquired current date/time matches any of the scheduled start dates/times (Step S35; Yes), the device controller 210 searches the schedule information table of FIG. 9 for the test-run ID, test-run mode information, and test-run unit address information associated with the scheduled start date/time information presenting the matched, scheduled start date/time. Then, the device controller 210 extracts the object ID from the test-run schedule ID. Subsequently, the information communicator 240 shown in FIG. 4 sends control signals presenting an operation mode change order for ordering change of the operation mode to the test-run mode presented by the found information and an operation order for ordering start of the operation to the address presented by the found information using a dedicated line extending to the building identified by the extracted object ID. Consequently, the test-run of the transmission destination air conditioner installed in the building starts (Step S36). Subsequently, the device controller 210 repeats the above processing from the Step S33.

If it is determined that the current date/time does not match any of the scheduled start dates/times in the Step S35 (Step S35; No), the device controller 210 determines whether the current date/time matches any of the scheduled end dates/times presented by the information stored in the schedule information table as shown in FIG. 9 (Step S37).

At this point, if it is determined that the current date/time matches any of the scheduled end dates/times (Step S37; Yes), the device controller 210 searches the schedule information table shown in FIG. 9 for the test-run schedule ID and test-run unit address information associated with the scheduled end date/time information presenting the matched, scheduled end date/time. Then, the information communicator 240 extracts the object ID from the test-run schedule ID and sends control signals presenting a stop order for ordering stop of the operation to the address presented by the found information using a dedicated line extending to the building identified by the extracted object ID. Consequently, the test-run of the transmission destination air conditioner ends (Step S38). Subsequently, the device controller 210 repeats the above processing from the Step S33.

If it is determined that the current date/time does not match any of the scheduled end dates/times in the Step S37 (Step S37; No), the device controller 210 searches for the object ID and test-run unit address information associated with the scheduled start date/time information presenting a date/time before the current date/time and scheduled end date/time information presenting a date/time after the current date/time.

A specific case in which the test-run unit address information "320*a*" is found will be described by way of example. The device controller 210 searches the connection information table of FIG. 7B for the cooling system ID associated with the same address information as the found test-run unit address information "320*a*" (namely the cooling system ID of the test-run air conditioner) "C001". Subsequently, the device controller 210 searches the connection information table of FIG. 7B for the address information associated with the found cooling system ID "C001" (namely the address information of the other air conditioners constituting the same cooling system as the test-run air conditioner) "310" and "320*b*."

Then, the information communicator 240 sends control signals for operation state information such as detected value information to be transmitted to the addresses presented by the address information of the found test-run air conditioner 320*a* and the address information of the other air conditioners 310 and 320*a* constituting the cooling system C001 of the air conditioner 320*a* at predetermined intervals such as in every one minute (Step S39).

After the Step S39 shown in FIG. 10, the information communicator 240 shown in FIG. 4 receives the operation state information such as detected value information and the sensor ID of the sensor that has detected the detected value presented by the detected value information from the air conditioners 310, 320*a* and 320*b* to which the control signals are sent (Step S40). Subsequently, the device controller 210 acquires the current date/time from the OS and designates the acquired date/time as the detection date/time when the detected value is detected. Then, the device controller 210 searches the detection item information table shown in FIG. 12 for the detection item information associated with the received sensor ID.

Subsequently, the device controller 210 associates and stores the object ID "A" found in the Step S38, found cooling system ID, address information, acquired detection date/time information presenting the detection date/time, found search item information, and received detected value information (namely stores the operation state information) in the information storage 220 using the operation state information table shown in FIG. 11 (Step S41), and repeats the above processing from the Step S33.

If it is determined that an operation end request has been entered in the Step S33 (Step S33; Yes), the device controller 210 ends the reference to the schedule information (Step S34), and ends the execution of the schedule execution procedure.

Figure 13:
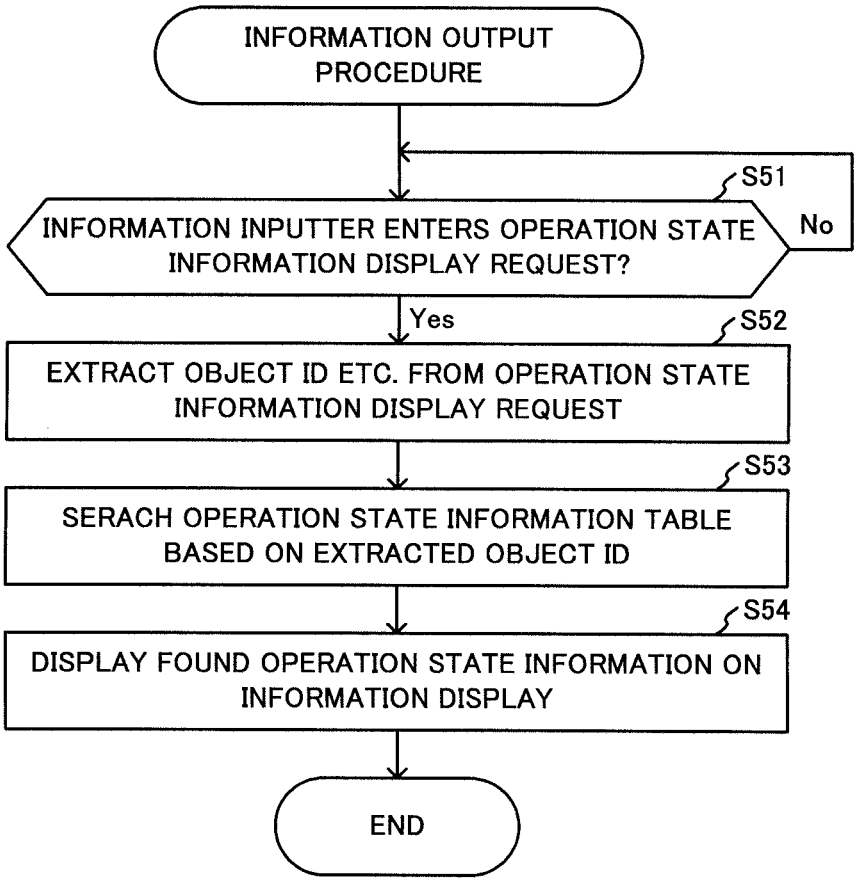
FIG. 13 is a flowchart presenting an example of the information output procedure executed by the air conditioner management device.

In order to check the operation state information collected by the air-conditioning management system 1, the user of the air-conditioning management system 1 conducts a predetermined operation on the operation device 200*i* to start executing an information output procedure to output the operation state information collected by the air conditioner management device 200. As the predetermined operation is conducted, the operation device 200*i* enters a predetermined signal corresponding to the operation into the CPU 200*a*. With the predetermined signal being entered, the CPU 200*a* starts executing the information output procedure as shown in FIG. 13. As the CPU 200*a* starts executing the information output procedure, the information display 250 shown in FIG. 4 displays a message urging entry of the address information identifying the air conditioner of which the operation state information is to be checked and the object ID of the building in which the air conditioner is installed.

Then, the user who has viewed the message decides to check the operation state information of the test-run air conditioner 320*a* installed in the building A. Then, as the user operates the operation device 200*i*, the information inputter 260 realized by the operation device 200*i* enters a request containing the object ID "A" and address information "320*a*" corresponding to the operation of the user and calling for display of the operation state information of the air conditioner 320*a* identified by the address information "320*a*" (the operation state information display request, hereafter).

Then, the device controller 210 determines whether an operation state information display request has been entered by the information inputter 260 (Step S51). At this point, the device controller 210 determines that an operation state information display request is entered by the information inputter 260 (Step S51; Yes), and extracts the address information "320*a*" and object ID "A" from the operation state information display request (Step S52). Here, if it is determined that no operation state information display request has been entered by the information inputter 260 (Step S51; No), the device controller 210 repeats the above processing from the Step S51 after a predetermined time has elapsed.

After the Step S52, the device controller 210 searches the operation state information table of FIG. 11 for the cooling system ID "C001" associated with the extracted object ID "A" and address information "320*a*." Then, the device controller 210 searches for the operation state information such as the address information, detection date/time information, detection item information, and detected value information associated with the found cooling system ID "C001" (namely of the air conditioners 310 and 320*b* constituting the cooling system C001 of the test-run air conditioner 320*a*) (Step S53).

Subsequently, the information display 250 shown in FIG. 4 displays the operation state information found in the Step S53 (Step S54), and ends the execution of the information output procedure.

With the above configuration, after the air conditioner 320*a* is operated, the operation state information presenting the operation state of the operated air conditioner 320*a* and the operation state information presenting the operation states of the air conditioners 310 and 320*b* connected to the air conditioner 320*a* are displayed. Here, if one of the interconnected air conditioners fails, the failure often affects the other air conditioners connected to the failed air conditioner. For that reason, the operation state information is displayed on the basis of interconnected air conditioners and thus it is possible to display a change in the operation states of the other air conditioners caused by the operation of an air conditioner.

Furthermore, with the above configuration, schedule information is entered, the operation of an air conditioner is controlled according to the schedule presented by the entered information, and the operation state information of the controlled air conditioner is acquired. Then, compared with the case in which the maintenance worker maintaining the air conditioners operates each air conditioner and checks the operation state of the air conditioner, it is possible not only to reduce the workload of the maintenance worker but also to prevent the air conditioners from being overlooked in operation check, thereby providing a precaution to prevent the air-conditioning management system 1 from failing.

Furthermore, with the above configuration, the operation of the air conditioners installed in the building identified by entered information is controlled, whereby the operation of the air conditioners can be controlled by building.

Furthermore, with the above configuration, the building in which an air conditioner of which the operation is controlled is installed, the operation state of the air conditioner, and the operation states of the air conditioners installed in the same building as the air conditioner is installed and connected to the air conditioner of which the operation is controlled are displayed, whereby the management of information presenting the operation states of the air conditioner 310 and the like is facilitated. Therefore, the above mentioned maintenance worker can easily pass down the know-how to a successor and thus it is easier to improve the efficiency of the task at the object-specific level. Furthermore, generally, air conditioners remain installed in the same building for, for example, ten years or longer. Therefore, for example, even if the maintenance worker for the air conditioner 310 and the like installed in the building is replaced, the operation states of the air conditioners can easily be managed and thus the operation states are easily managed as before the worker is replaced.

Here, if a failure occurs among air conditioners connected to each other via refrigerant pipes, the failure often affects the air conditioners connected to the failed air conditioner via refrigerant pipes. Therefore, with the above configuration, the operation states of the air conditioners constituting the same cooling system as the air conditioner of which the operation is controlled are displayed, whereby it is possible to efficiently check whether the operation states of multiple air conditioners are normal in accordance with the relationship between refrigerant pipes in connection.

In the above explanation, the operation states of the air conditioners constituting the air-conditioning management system 1 are presented by the temperature of the refrigerant running through the refrigerant pipes connected to the air conditioners. This is not restrictive. For example, the air-conditioning management system 1 can comprise sensors detecting the pressure of the refrigerant in the refrigerant pipes, in place of or in addition to the sensors detecting the temperature of the refrigerant running through the refrigerant pipes connected to the air conditioners, and present the operation states of the air conditioners by the pressure of the refrigerant or by both the temperature and pressure of the refrigerant.

In the above explanation, the schedule information table shown in FIG. 9 stores the schedule information presenting test-run schedules. This is not restrictive. Schedule information presenting normal operation schedules can be stored.

Modified Embodiment 1

In the above explanation, the information inputter 260 shown in FIG. 4 enters a connection information acquisition request in the Step S11 shown in FIG. 5, enters the address information of an air conditioner in the Step S14, enters a connection display request in the Step S21 shown in FIG. 8, enters scheduled start date/time information and the like in the Step S25, enters an operation start request in the Step S31 shown in FIG. 10, enters an operation end request in the Step S33, and enters an operation state information display request in the Step S51 of FIG. 13. However, this is not restrictive. It is possible that the external inputter 231 shown in FIG. 4 enters a connection information acquisition request, enters the address information, enters a connection display request, enters scheduled start date/time information and the like, enters an operation start request, enters an operation end request, and enters an operation state information display request.

In the above explanation, the information display 250 shown in FIG. 4 displays the connection destination information and the like in the Step S24 shown in FIG. 8 and displays the operation state information in the Step S54 shown in FIG. 13. However, this is not restrictive. It is possible that the external outputter shown in FIG. 4 outputs the connection destination information and the like and the operation state information to the terminal 101 and the terminal 101 displays the connection destination information and the like and the operation state information.

With the above configuration, it is possible to check the operation of the air conditioner 310 and the like from some other place where the terminal 101 is installed, not from the place where the air conditioner management device 200 is installed. Therefore, it is possible not only to operate the air conditioner 310 and the like according to orders from the maintenance workers at different places but also to allow the maintenance workers at different places to check the operation of the air conditioner 310 and the like, thereby improving the quality of maintenance work on the air conditioner 310 and like.

Modified Embodiment 2

In the Step S51 of FIG. 13, the operation state information display request entered by the information inputter 260 of FIG. 4 can further contain reference start date/time information and reference end date/time information in addition to the object ID and address information. Furthermore, in the Step S52, the device controller 210 searches the operation state information table shown in FIG. 11 for the cooling system ID associated with the object ID and address information extracted from the operation state information display request. Then, the device controller 210 can search the address information, detection date/time information, detection item information, and detected value information associated with the found cooling system ID and detection date/time information presenting a date/time after the date/time presented by the reference start date/time information and before the date/time presented by the reference end date/time information.

With the above configuration, the operation state information detected after the date/time presented by the entered reference start date/time information and before the date/time presented by the entered reference end date/time information is displayed. Then, the operation state of the air conditioner 310 and the like during a predetermined time period can easily be checked.

The above embodiment and Modified Embodiments 1 and 2 of the embodiment can be combined with each other. Needless to say, the air conditioner management device 200 comprising the configuration for realizing the functions according to any of the above embodiment and Modified Embodiments 1 and 2 of the embodiment in advance can be provided. In addition, it is possible to make an existing air conditioner management device function as the air conditioner management device 200 according to any of the above embodiment and Modified Embodiments 1 and 2 of the embodiment by application of programs. In other words, it is possible to make an existing air conditioner management device function as the air conditioner management device 200 according to the embodiment by applying the control programs realizing the functional configuration of the air conditioner management device 200 exemplified by any of the above embodiment and Modified Embodiments 1 and 2 of the embodiment so that the computer (CPU or the like) controlling the existing air conditioner management device can execute the programs.

The above programs can be distributed by any method. For example, the programs can be stored and distributed on a recording medium such as a memory card, CD-ROM, and DVD-ROM, or distributed via a communication medium such as the Internet. Incidentally, the air conditioner management method of the present invention can be implemented using the air-conditioner management device 200.

Furthermore, when the above-described functions are partially realized by an OS (operation system) or realized by cooperation of an OS and application programs, only the non-OS part can be stored and distributed on a medium or downloaded.

Various embodiments and modifications are available to the present invention without departing from the broad sense of spirit and scope of the present invention. The above-described embodiments are given for explaining the present invention and do not confine the scope of the present invention. In other words, the scope of the present invention is set forth by the scope of claims, not by the embodiments. Various modifications made within the scope of claims and scope of significance of the invention equivalent thereto are considered to fall under the scope of the present invention.

INDUSTRIAL APPLICABILITY

The present invention is suitable for air conditioner management devices managing the air conditioners conditioning the air in a room.

The invention claimed is:

1. An air conditioner management device, comprising:

an information storage associating and storing identification information for a circulation system circulating a refrigerant via a refrigerant pipe, identification information for a first air conditioner to which the refrigerant is supplied by the circulation system, identification information for a second air conditioner connected to the first air conditioner via the refrigerant pipe, and identification information for a third air conditioner connected to the first air conditioner or to the second air conditioner via the refrigerant pipe;

an information inputter entering schedule information presenting a schedule for operating the first air conditioner;

a device controller controlling the operation of the first air conditioner based on the schedule information entered by the information inputter;

an information communicator transmitting a control signal after the schedule starts to the first air conditioner controlled by the device controller and to the second air conditioner and the third air conditioner identified by the identification information associated with the identification information for the first air conditioner wherein the control signal requests an air conditioner to transmit operation state information presenting an operation state of the air conditioner, and then receiving operation state information of the first air conditioner, operation state information of the second air conditioner, and operation state information of the third air conditioner; and an information display associating and displaying the identification information for the circulation system stored in the information storage in association with the identification information for the first air conditioner of which the operation is controlled by the device controller, the operation state information of the first air conditioner, the operation state information of the second air conditioner, and the operation state information of the third air conditioner that are received by the information communicator.

2. The air conditioner management device according to claim 1, wherein the information storage further stores identification information for an object in which the first air conditioner and second air conditioner are installed in association with the identification information for the first air conditioner and the identification information for the second air conditioner, the information inputter further enters identification information for the object in which an air conditioner of which the operation is to be controlled is installed, the information display displays identification information for an air conditioner stored in the information storage in association with the identification information for the object entered by the information inputter, the information inputter enters schedule information presenting a schedule for operating the air conditioner identified by the information displayed by the information display, and the device controller controls the operation of the air conditioner identified by the displayed information based on the schedule information entered by the information inputter.

3. The air conditioner management device according to claim 2, wherein the device controller associates and stores the acquired operation state information, identification information for the air conditioner in the operation state, and identification information for the object in which the air conditioner is installed, in the information storage, and the information display displays the identification information for the object in which the air conditioner of which the operation is controlled by the device controller is installed, operation state information of the air conditioner of which the operation is controlled, identification information for an air conditioner stored in the information storage in association with the identification information for the air conditioner of which the operation is controlled and with the identification information for the object, and the operation state information of the air conditioner.

4. An air conditioner management system comprising a plurality of air conditioners connected to one another via a refrigerant pipe through which a refrigerant runs and an air conditioner management device that manages the plurality of air conditioners, the air conditioner management device including:

an information storage associating and storing identification information for a circulation system circulating the refrigerant via the refrigerant pipe, identification information for a first air conditioner to which the refrigerant is supplied by the circulation system, identification information for a second air conditioner connected to the first air conditioner via the refrigerant pipe, and identification information for a third air conditioner connected to the first air conditioner or to the second air conditioner via the refrigerant pipe;

an information inputter entering schedule information presenting a schedule for operating the first air conditioner;

a device controller controlling the operation of the first air conditioner based on the schedule information entered by the information inputter;

an information communicator transmitting a control signal after the schedule starts to the first air conditioner controlled by the device controller and to the second air conditioner and the third air conditioner identified by the identification information associated with the identification information for the first air conditioner wherein the control signal requests an air conditioner to transmit operation state information presenting an operation state of the air conditioner, and then receiving operation state information of the first air conditioner, operation state information of the second air conditioner, and operation state information of the third air conditioner; and an information display associating and displaying the identification information for the circulation system stored in the information storage in association with the identification information for the first air conditioner of which the operation is controlled by the device controller, the operation state information of the first air conditioner, the operation state information of the second air conditioner, and the operation state information of the third air conditioner that are received by the information communicator.

5. A non-transitory computer readable recording medium having stored thereof an air conditioner management program that allows a computer to function as:

an information storage associating and storing identification information for a circulation system circulating a refrigerant via a refrigerant pipe, identification information for a first air conditioner to which the refrigerant is supplied by the circulation system, identification information for a second air conditioner connected to the first air conditioner via the refrigerant pipe, and identification information for a third air conditioner connected to the first air conditioner or to the second air conditioner via the refrigerant pipe;

an information inputter entering schedule information presenting a schedule for operating the first air conditioner;

a device controller controlling the operation of the first air conditioner based on the schedule information entered by the information inputter;

an information communicator transmitting a control signal after the schedule starts to the first air conditioner controlled by the device controller and to the second air conditioner and the third air conditioner identified by the identification information associated with the identification information for the first air conditioner wherein the control signal requests an air conditioner to transmit operation state information presenting an operation state of the air conditioner, and then receiving operation state information of the first air conditioner, operation state information of the second air conditioner, and operation state information of the third air conditioner; and an information display associating and displaying the identification information for the circulation system stored in the information storage in association with the identification information for the first air conditioner of which the operation is controlled by the device controller, the operation state information of the first air conditioner, the operation state information of the second air conditioner, and the operation state information of the third air conditioner that are received by the information communicator.

6. An air conditioner management method, comprising:

an information input step of entering schedule information presenting a schedule for operating a first air conditioner;

a device control step of controlling the operation of the first air conditioner based on the schedule information entered in the information input step;

a transmission step of transmitting a control signal after the schedule starts to the first air conditioner controlled in the device control step and to a second air conditioner and a third air conditioner identified by identification information associated with identification information for the first air conditioner in an information storage, wherein the information storage associates and stores identification information for a circulation system circulating a refrigerant via a refrigerant pipe, the identification information for a first air conditioner to which the refrigerant is supplied by the circulation system, the identification information for the second air conditioner connected to the first air conditioner via the refrigerant pipe, and the identification information for the third air conditioner connected to the first air conditioner or to the second air conditioner via the refrigerant pipe, and wherein the control signal requests an air conditioner to transmit operation state information presenting an operation state of the air conditioner;

a receiving step of receiving operation state information of the first air conditioner, operation state information of the second air conditioner, and operation state information of the third air conditioner; and an information display step of associating and displaying the identification information for the circulation system stored in the information storage in association with the identification information for the first air conditioner of which the operation is controlled in the device control step, the operation state information of the first air conditioner, the operation state information of the second air conditioner, and the operation state information of the third air conditioner that are received in the receiving step.

* * * * *